US008851176B2

(12) United States Patent
Noble et al.

(10) Patent No.: US 8,851,176 B2
(45) Date of Patent: Oct. 7, 2014

(54) SUBSEA HYDROCARBON RECOVERY

(75) Inventors: Peter G. Noble, Spring, TX (US); Randall S. Shafer, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 71 days.

(21) Appl. No.: 13/422,549

(22) Filed: Mar. 16, 2012

(65) Prior Publication Data

US 2012/0247781 A1 Oct. 4, 2012

Related U.S. Application Data

(60) Provisional application No. 61/468,665, filed on Mar. 29, 2011.

(51) Int. Cl.
*E21B 43/01* (2006.01)

(52) U.S. Cl.
CPC ..... *E21B 43/0122* (2013.01)
USPC ..... 166/302; 166/369; 166/57; 166/344; 166/364

(58) Field of Classification Search
USPC ..... 166/302, 369, 57, 363, 364, 355, 344, 166/350
See application file for complete search history.

(56) References Cited

U.S. PATENT DOCUMENTS

| | | | | |
|---|---|---|---|---|
| 3,674,150 | A | 7/1972 | Lejeune | |
| 4,324,505 | A | 4/1982 | Hammett | |
| 4,456,071 | A | 6/1984 | Milgram | |
| 5,950,732 | A * | 9/1999 | Agee et al. | 166/354 |
| 6,220,787 | B1 | 4/2001 | Tanabe et al. | |
| 6,994,159 | B2 * | 2/2006 | Wendland | 166/57 |
| 8,297,361 | B1 * | 10/2012 | Root | 166/364 |
| 2002/0157833 | A1 * | 10/2002 | Wilson | 166/344 |
| 2005/0092482 | A1 | 5/2005 | Wendland | |
| 2005/0103498 | A1 * | 5/2005 | Yemington | 166/302 |
| 2006/0060356 | A1 | 3/2006 | Graue et al. | |
| 2007/0114026 | A1 | 5/2007 | La Rovere et al. | |
| 2008/0135256 | A1 | 6/2008 | Daniel et al. | |
| 2008/0135257 | A1 | 6/2008 | Zhang et al. | |
| 2008/0138159 | A1 | 6/2008 | Daniel et al. | |
| 2009/0056936 | A1 * | 3/2009 | McCoy, Jr. | 166/250.01 |
| 2009/0200032 | A1 * | 8/2009 | Foret | 166/302 |
| 2011/0005452 | A1 * | 1/2011 | Baylot et al. | 114/331 |
| 2013/0046126 | A1 | 2/2013 | Varney et al. | |

FOREIGN PATENT DOCUMENTS

| | | |
|---|---|---|
| WO | 2011137535 | 11/2011 |

OTHER PUBLICATIONS

PCT/US2012/029472 PCT International Search Report (PCT/ISA/210) Dated May 11, 2012.

* cited by examiner

*Primary Examiner* — James Sayre
(74) *Attorney, Agent, or Firm* — ConocoPhillips Company

(57) ABSTRACT

The present invention relates to recovery of hydrocarbons being released subsea in an uncontrolled manner. More specifically, the invention relates to an apparatus, process and system for the recovery of well stream products being released subsea in an uncontrolled manner, optionally under conditions that are conducive to the formation of gas hydrate crystals.

19 Claims, 1 Drawing Sheet

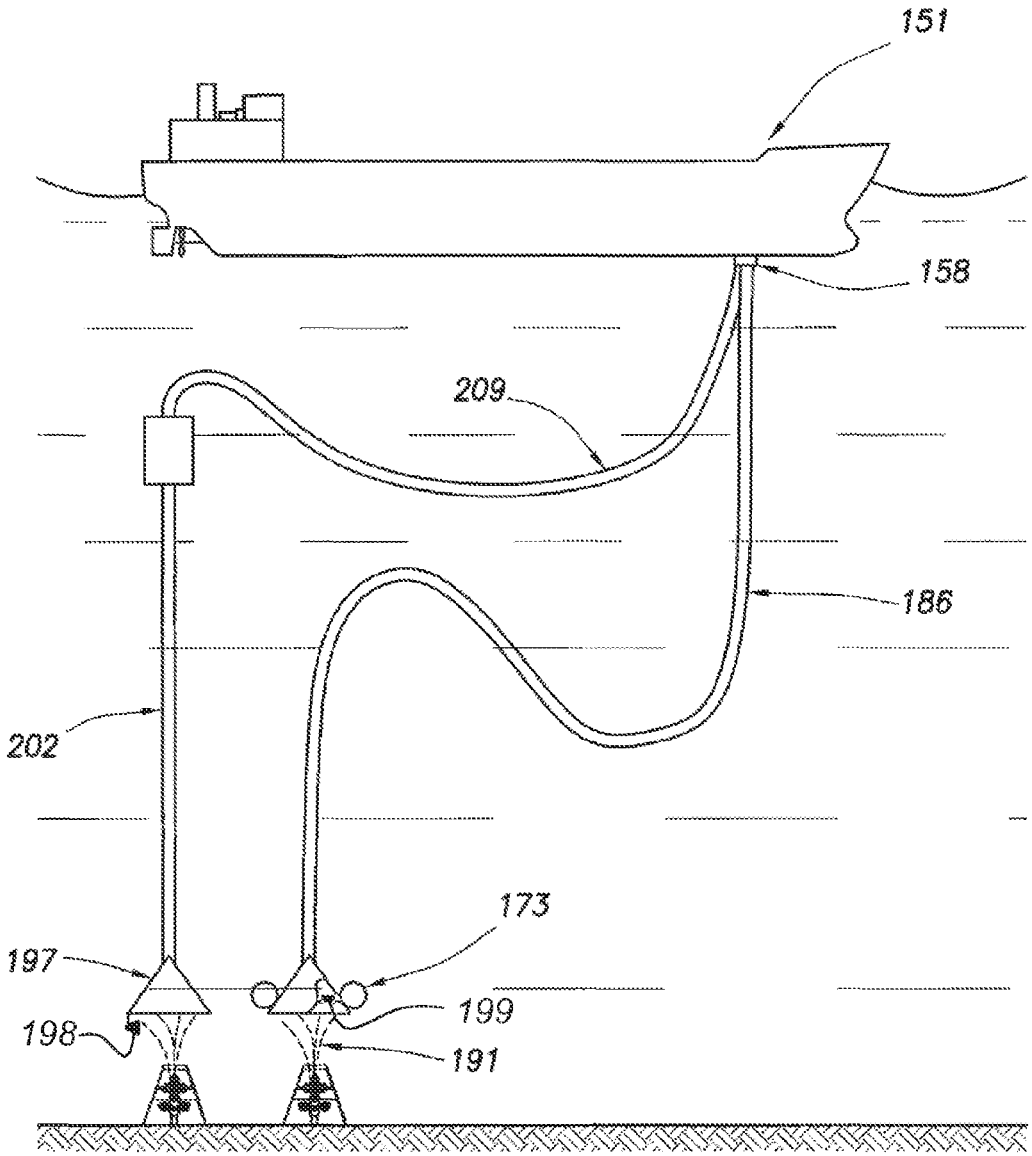
151
158
209
186
202
173
197
199
198
191

SUBSEA HYDROCARBON RECOVERY

CROSS-REFERENCE TO RELATED APPLICATIONS

This application is a non-provisional application which claims benefit under 35 USC §119(e) to U.S. Provisional Application Ser. No. 61/468665 filed Mar. 29, 2011, entitled SUBSEA HYDROCARBON RECOVERY," which is incorporated herein in its entirety.

STATEMENT REGARDING FEDERALLY SPONSORED RESEARCH OR DEVELOPMENT

None.

FIELD OF THE INVENTION

The present disclosure relates to recovery of hydrocarbons being released subsea in an uncontrolled manner. More specifically, the invention relates to the recovery of well stream products being released in an uncontrolled manner due to a subsea well failure.

BACKGROUND

Recent events have revealed a need for improved technology to quickly respond to an uncontrolled release of well stream products. These events also revealed that under certain conditions, recovery of hydrocarbons from a well blowout at can be hampered by the formation of gas hydrate crystals with the potential to clog collection devices.

In the 2010 Macondo well incident, the recovery system that was eventually deployed was both complex and expensive to operate, requiring numerous surface vessels to collect, process, burn and/or store the recovered hydrocarbon mixture. The complexity of this operation and the number of large vessels required preclude rapid deployment in the event of a similar future mishap. What is needed are more effective hydrocarbon recovery apparatus, systems and processes that are suitable for use in environments where gas hydrate formation can significantly hamper the underwater recovery of released hydrocarbons, at a cost that will allow the system to be pre-staged at a number of key locations for rapid deployment if needed.

BRIEF SUMMARY OF THE DISCLOSURE

The invention described herein provides unique apparatus, processes and systems for effective underwater recovery of well stream products emanating from an uncontrolled source, such as a well blowout.

In certain embodiments, the invention comprises a collection device having a body portion that directs the flow of the hydrocarbon mixture into at least one conduit that penetrates the body portion, as well as a bottom portion that is connected to the body portion and allows entry of the hydrocarbon mixture into the body portion. Additionally, the device employs at least one mechanism for preventing the formation of gas hydrate crystals inside the device, wherein the mechanism may be at least one internal screen (that optionally is heated), at least one heating device, at least one injector adapted for injecting a fluid to prevent the formation of gas hydrate crystals. Alternatively, the device may employ combinations of these mechanisms, and may also include at least one positioning device adapted for providing thrust to allow the apparatus to be moved via remote control.

The invention described herein additionally provides a process for collecting a hydrocarbon mixture in an underwater environment, comprising: (a) providing the apparatus of claim 1, (b) positioning the apparatus over an underwater source of uncontrolled hydrocarbon emissions, (c) collecting at least a portion of the hydrocarbon mixture in the apparatus, wherein the formation of gas hydrate crystals inside the apparatus and conduit is inhibited by one or more mechanisms employed to prevent clogging of the apparatus by gas hydrate crystals. These mechanisms may include providing at least one internal screen to retain gas hydrate crystals, providing at least one heating device inside the apparatus, or injecting a fluid via at least one injector to prevent the formation of gas hydrate crystals. Fluids that may be injected include, for example, salt solutions, methanol, ethylene glycol, propylene glycol, kinetic hydrate inhibitors, poly(N-vinyl pyrrolidone), N-vinylcaprolactam, dimethylamino-ethylmethacrylate, quaternary ammonium bromide, or anti-agglomerants.

The inventive process additionally provides for the collected hydrocarbon mixture to be conveyed in at least one conduit to at least one surface vessel that may optionally employ a submerged turret loading system. Once onboard, the hydrocarbon mixture is separated to produce gaseous hydrocarbons, liquid hydrocarbons and water, and the separated liquid hydrocarbons are stored. The conduit employed may be a top-tensioned riser, a free-standing hybrid riser, a steel catenary riser or a flexible riser.

Certain embodiments of the current invention provide a system for collecting hydrocarbons in an underwater environment, comprising the unique collection device (described above) together with at least one conduit for conducting the hydrocarbon and water mixture to at least one surface vessel; at least one surface vessel for receiving the hydrocarbon mixture; and a processing system located on the surface vessel (that may employ a submerged turret loading system) for separating the hydrocarbon mixture into gaseous hydrocarbons, liquid hydrocarbons and water.

BRIEF DESCRIPTION OF THE DRAWINGS

A more complete understanding of the present invention and benefits thereof may be acquired by referring to the follow description taken in conjunction with the accompanying drawings in which:

FIG. 1 is a simplified schematic in accordance with two alternative embodiments of the present disclosure, each embodiment comprising a unique collection device, a riser for conducting collected hydrocarbons and a dynamically-positioned submerged turret loading tanker. The invention is susceptible to various modifications and alternative forms, specific embodiments thereof are shown by way of example in the drawings. The drawings may not be to scale. It should be understood that the drawings and their accompanying detailed descriptions are not intended to limit the scope of the invention to the particular form disclosed, but rather, the intention is to cover all modifications, equivalents and alternatives falling within the spirit and scope of the present invention as defined by the appended claims.

DETAILED DESCRIPTION

The system and process of the current disclosure is illustrated by the schematic of FIG. 1, which depicts a basic overview of two alternative embodiments. Common to both embodiments is a dynamically-positioned tanker surface vessel 151 equipped with a submerged turret loading (STL) system 158, which will be discussed later in more detail. One embodiment depicted comprises a collection device having remote-controlled positioning devices 173 and a buoyant flexible riser 186 that is positioned over an uncontrolled underwater release of hydrocarbons 191. A second embodiment depicted comprises a collection device 197 attached to the bottom of a free-standing hybrid riser system 202 that is supported by at least one buoyancy tank. This free-standing riser connects to the STL-equipped tanker via a flexible riser conduit 209. Examples of additional embodiments are discussed in more detail below.

The current invention includes a collection device. The exact shape of the collection device is not important, as long as the device functions to effectively collect an upwardly rising hydrocarbon mixture of gas and oil mixed with water, and directs the mixture into at least one conduit, or riser, that leads to the surface of the body of water in which the device is deployed. In one embodiment, the collection device may have a cylindrical body portion connected adjacent to a flared, conically-shaped bottom portion, with the bottom portion containing an orifice for allowing entry of the rising hydrocarbon mixture into the device. In another embodiment, the device may have a pyramidal shaped body portion connected adjacent to a bottom portion that contains an orifice for hydrocarbon entry. In yet another embodiment, the collection device may have a conically-shaped body portion, connected adjacent to a cylindrically-shaped bottom portion that may be either metal in construction, or comprise a flexible shroud. In still another embodiment, the body portion and bottom portion may together form a conically-shaped collection device.

The collection device may optionally comprise one or more positioning apparatus attached to the exterior of the collection device that are capable of exerting a force to allow the collection device to be moved via remote control. In certain embodiments, each positioning apparatus is an electric thruster that can be powered and controlled remotely by the surface vessel. Thrusters generally have a motor and one or more rotating blades that provide an underwater thrust or motive force. Thrusters may be remotely operated, with the remote pilot assisted by the help of depth sensors, lights, and underwater video cameras, all of which may be attached to the collection device. These guidance technologies would be similar to those employed to guide underwater remotely operated vehicles (ROVs), are all well-understood in the art, and are available commercially from a number of sources. Once the collection device is positioned correctly above the flow of the hydrocarbon mixture, it may continue to be dynamically positioned by the operation of said thruster (or thrusters). Alternatively, the collection device may be moored in place by attachment to the seafloor.

In an alternative embodiment, the collection device may lack self-contained positioning devices, and instead be guided by the assistance of one or more ROVs that may use one or more robotic arms to grab the collection device and convey the apparatus to a specific location for the collection of a given hydrocarbon mixture. Once the collection device is positioned correctly above the flow of the hydrocarbon mixture, one or more ROVs may continue to hold the device in proper position, or the device may optionally be moored in place by attachment to the seafloor.

Using the collection device in certain environments may necessitate that one or more mechanisms be employed to prevent the formation of gas hydrate crystals that could block of the flow of hydrocarbons through the collection device and the riser conduit. Gas hydrates are crystalline solid inclusion compounds consisting of a host water lattice composed of cavities that enclathrate individual gas molecules. The structure of the water lattice is determined by the size of the "guest" molecule and the composition of the gas mixture. Typical guest molecules include: methane, ethane, propane, carbon dioxide and hydrogen sulfide. Gas hydrates are formed when water and gas are combined at low temperature and generally high pressure (e.g. temperatures below 2° C. and pressures greater than 1.5 MPa for natural gas hydrates).

In certain embodiments, one or more mechanisms may be employed to prevent hydrate-mediated clogging of the collection device. In certain embodiments, such mechanisms may include at least one screen 199 inside the device that is capable of retaining gas hydrate crystals that would otherwise potentially clog flow of a hydrocarbon mixture through the collection device. Optionally, each screen may be heated by any of a variety of different means to facilitate melting of any retained gas hydrate crystals. Such mechanisms may include, but are not limited to, resistive heating, inductive heating, or flowing a heated fluid through hollow wires that are arranged to comprise the aforementioned screen.

In certain embodiments, the mechanism utilized to prevent clogging of the collection device by hydrate crystals may include any pump capable of removing slurries. Such pumps may include, but are not limited to, a commercially available two-phase slurry pump.

In certain embodiments, the mechanism for preventing hydrate-mediated clogging of the collection device may involve at least one injector 198 that injects a fluid to help prevent the formation of gas hydrate crystals. Established technology utilized by the petroleum and gas industries for preventing gas hydrate formation in pipelines consists of the introduction of a 'thermodynamic' inhibitor into the pipeline via one or more injectors. The addition of a sufficient amount of one or more of these compounds moves the conditions required for hydrate formation to a combination of lower temperature and higher pressure. An alternative technology to thermodynamic inhibition is focused on developing low-dosage chemicals that function to delay hydrate formation to longer times than the residence time of the gas within the area prone to forming hydrate crystals. These new low dosage inhibitors can offer significant economic and environmental advantages in comparison to traditional thermodynamic inhibitors. Fluids that can be utilized for inhibiting blockage by gas hydrate crystals may include, for example, salt solutions, methanol, ethylene glycol, propylene glycol, kinetic hydrate inhibitors, poly(N-vinyl pyrrolidone), N-vinylcaprolactam, dimethylamino-ethylmethacrylate, quaternary ammonium bromide, or anti-agglomerants. It is noted that any of the mechanisms listed above may be utilized alone, or in combination for preventing clogging of the collection device.

The collection device conveys the collected hydrocarbon mixture to a surface vessel via at least one conduit. This conduit forms a connection with, and penetrates the body portion of the collection device, thereby providing an exit point from the collection device for the collected hydrocarbon mixture and allowing the mixture to be conveyed to a surface vessel. The conduit utilized may comprise any riser that is compatible with the depths at which recovery of hydrocarbons occurs. In certain embodiments, the riser may be a top-tensioned (or vertically-tensioned) riser, a free-standing hybrid riser, a steel catenary riser or a flexible riser. These risers are all well-known in the art and available commercially from multiple vendors. Top-tensioned (or vertically-tensioned) risers may have a rigid tensioned riser that stands vertically and may be supported at the upper end by one or more buoyancy tanks Free-standing hybrid risers have a rigid vertical section that is supported by at least one buoyancy tank near the top of the riser. The top of the rigid section is connected to a surface vessel via a flexible jumper conduit, while the bottom of the rigid section is connected to the hydrocarbon collection device, either directly, or via a second flexible jumper conduit. Steel catenary risers may also be utilized, and may be preferred at water depths greater than 2,000 meters. These risers include fatigue-resistant threaded mechanical connectors to connect the pipe joints, and a thick coating of thermal insulating material. Flexible risers comprise multiple layers designed to address field specific constraints such as pressure, water depth, temperature and characteristics of the transmitted fluid. Their construction is based on a helical arrangement of metallic wires and tape, along with extruded thermoplastics to form a composite pipe structure. The flexible nature of the riser enables it to absorb vertical movements at either end without transmitting dynamic loadings.

If a significant quantity of gas is present in the escaping hydrocarbons, the gas should provide sufficient lift to direct the hydrocarbon mixture up the riser to the surface vessel without the need for additional pumping. However, if needed, a supplemental lift mechanism may be utilized to assist in conveying the hydrocarbon mixture up the riser to the surface vessel. Such mechanisms may include a gas-lift injection system wherein a gas is either run downward from the surface vessel through a separate conduit, or through the annulus within the riser. The injected gas combines with the collected hydrocarbons within the riser and provides a lifting force to direct the flow of the hydrocarbon mixture upward toward the surface vessel. Alternatively, a lifting pump may be installed at some point in the riser, or onboard the surface vessel, to provide a motive force to direct the flow of the collected hydrocarbon mixture upward toward the surface vessel. Implementation of these supplemental lift mechanisms is familiar to those having knowledge the art.

The current invention utilizes surface vessels, or tankers, equipped with a submerged turret loading (STL) system. These vessels are often large (up to 125,000 mT or more), have tanks capable of storing large quantities of fluid (particularly liquid hydrocarbons), and may possess dynamic-positioning thrusters such that no mooring is required to hold the vessel in a stationary position. STL technology is well-understood by those having experience in the art, and thus will be discussed here only in overview. The subsurface buoy of the loading system is designed to fit upward into a specially-configured compartment in the hull of the tanker. The interface between compartment and buoy has been standardized within the industry to facilitate interchangeability. The STL compartment houses a large swivel around which the tanker vessel can rotate to prevent excessive twisting torque on the riser when the buoy is connected to the vessel. A flexible riser, or flexible jumper connection, is connected to the buoy for conducting the hydrocarbon mixture to the vessel from the collection device located near the source of escaping hydrocarbons. In certain embodiments, the STL buoy is moored to the seafloor using wire rope or chains at an underwater depth of 30 to 40 meters, well below the draught of any ship traffic that might inadvertently stray into the area. The moored buoy floats in an equilibrium position at the selected depth, with a pick-up line to the surface for enabling convenient attachment of the buoy to the loading turret of the STL-equipped vessel. Once attached to the STL-equipped vessel, the buoy may remain moored to the seafloor, and rapid disconnect of the buoy from the vessel is possible if emergency evacuation from the recovery site is required, such as in the event of extreme bad weather. In certain alternative embodiments, and to enable rapid deployment of the hydrocarbon recovery system at the site of an uncontrolled release of hydrocarbons, the STL buoy may be attached to the surface vessel and remain unmoored from the seafloor.

Once onboard the surface vessel, the collected hydrocarbon mixture is directed to at least one processing device located on the surface vessel. In certain embodiments, each processing device is modular in design, enabling one or more modules to be quickly installed onboard the vessel, while in other embodiments, each processing device is permanently installed onboard the vessel. Each processing device is capable of separating gaseous hydrocarbons from liquids, and then separating liquid hydrocarbons from water, directing the liquid hydrocarbons to storage, while returning the water to the body of water in which the vessel is operating. The gaseous hydrocarbon may be vented, or if needed, flared. The technology for accomplishing the separation of the hydrocarbon mixture is well-established and known to those having knowledge in the art.

The design of the current inventive apparatus, system and process allows for the effective recovery an uncontrolled release of hydrocarbons into a body of water. Certain embodiments are designed for effective collection of hydrocarbons at depths that are conducive to the formation of gas hydrate crystals. The current inventive system comprises a novel collection device and hydrocarbon recovery system, along with a novel process for hydrocarbon recovery that increases the overall efficiency of the process, decreases cost, and enables its rapid deployment.

It should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the apparatus, systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

We claim:

1. A device for collecting a hydrocarbon mixture in an underwater environment, comprising:

a body portion adapted for directing the flow of a hydrocarbon mixture into a conduit, wherein a bottom of the body portion has an opening that allows entry of the hydrocarbon mixture into the body portion;

at least one conduit that penetrates said body portion and receives said hydrocarbon mixture, wherein said hydrocarbon mixture comprises water and a member of the group consisting of gaseous hydrocarbons, liquid hydrocarbons and mixtures thereof;

at least one heated internal screen for preventing the formation of gas hydrate crystals inside the device, wherein each internal screen is heated by a mechanism selected from the group consisting of inductive heating and flowing a heated fluid through hollow wires that are arranged to comprise said internal screen.

2. The device of claim 1, further comprising at least one positioning apparatus, wherein said positioning apparatus is capable of providing thrust to allow the apparatus to be moved via remote control.

3. The device of claim 2, wherein each positioning apparatus comprises an electric thruster.

4. The device of claim 1, wherein each internal screen is heated by flowing the heated fluid through the hollow wires.

5. The device of claim 1, wherein each conduit comprises a member selected from the group consisting of a top-tensioned riser, a free-standing hybrid riser, a flexible riser and combinations thereof.

6. The device of claim 1, further comprising an injector adapted for injecting a fluid comprising a member of the group consisting of salt solutions, methanol, glycols, kinetic hydrate inhibitors, poly(N-vinyl pyrrolidone), N-vinylcaprolactam, dimethylamino-ethylmethacrylate, quaternary ammonium bromide, anti-agglomerants, and combinations thereof.

7. A method for collecting a hydrocarbon mixture in an underwater environment, comprising:

positioning a device underwater above a source that is producing a hydrocarbon mixture, wherein said hydrocarbon mixture comprises water and a member of the group consisting of gaseous hydrocarbons, liquid hydrocarbons and mixtures thereof;

collecting at least a portion of the hydrocarbon mixture with the device, heating at least one internal screen inside the device to at least partially prevent clogging of the device due to gas hydrate crystals, wherein each internal screen is heated by a mechanism selected from the group consisting of inductive heating and flowing a heated fluid through hollow wires that are arranged to comprise said internal screen, thereby melting at least a portion of any hydrate crystals retained on the screen;

conveying the hydrocarbon mixture collected with the device via at least one conduit to at least one surface vessel;

separating the hydrocarbon mixture onboard said at least one surface vessel, to produce gaseous hydrocarbons, liquid hydrocarbons and water;

storing the separated liquid hydrocarbons onboard said at least one surface vessel.

8. The method of claim 7, wherein the device further comprises at least one positioning apparatus that is capable of providing thrust to allow the device to be moved via remote control.

9. The method of claim 7, wherein each internal screen is heated by flowing the heated fluid through the hollow wires.

10. The method of claim 7, further comprising injecting into the hydrocarbon mixture a fluid comprising a member of the group consisting of salt solutions, methanol, glycols, kinetic hydrate inhibitors, poly(N-vinyl pyrrolidone), N-vinylcaprolactam, dimethylamino-ethylmethacrylate, quaternary ammonium bromide, anti-agglomerants and combinations thereof.

11. The method of claim 7, wherein each conduit comprises a member selected from the group consisting of a top-tensioned riser, a free-standing hybrid riser, a flexible riser and combinations thereof.

12. The method of claim 7, wherein the hydrocarbon mixture is loaded into each surface vessel via a submerged turret loading system.

13. A system for collecting hydrocarbons in an underwater environment, comprising:

a) a device for collecting a hydrocarbon mixture in an underwater environment, comprising:

a body portion that connects to at least one conduit that penetrates the body portion, wherein said body portion is adapted for directing the flow of a hydrocarbon mixture from said body portion into the conduit and a bottom of the body portion has an opening that allows entry of the hydrocarbon mixture into the body portion, wherein said hydrocarbon mixture comprises water and a member of the group consisting of gaseous hydrocarbons, liquid hydrocarbons and mixtures thereof;

at least one heated internal screen for preventing the formation of gas hydrate crystals inside the device, wherein each internal screen is adapted for being heated by a mechanism selected from the group consisting of inductive heating and flowing a heated fluid through hollow wires that are arranged to comprise said internal screen;

b) at least one conduit for conducting the hydrocarbon mixture to at least one surface vessel;

c) at least one surface vessel connected to said at least one conduit, each surface vessel being adapted for receiving the hydrocarbon mixture via said at least one conduit;

d) a processing system located onboard each surface vessel adapted for separating the hydrocarbon mixture into gaseous hydrocarbons, liquid hydrocarbons and water.

14. The system of claim 13, wherein said at least one conduit comprises a member selected from the group consisting of a top-tensioned riser, a free-standing hybrid riser, a flexible riser and combinations thereof.

15. The system of claim 13, wherein the device of part (a) further comprises at least one positioning apparatus attached to the device, wherein each positioning apparatus is adapted for providing thrust to allow the device of part (a) to be moved via remote control.

16. The system of claim 15, wherein each positioning apparatus comprises an electric thruster.

17. The system of claim 13, wherein each internal screen is adapted for being heated by flowing the heated fluid through the hollow wires.

18. The system of claim 13, further comprising an injector adapted for injecting a fluid comprising a member of the group consisting of salt solutions, methanol, ethylene glycol, propylene glycol, kinetic hydrate inhibitors, poly(N-vinyl pyrrolidone), N-vinylcaprolactam, dimethylamino-ethylmethacrylate, quaternary ammonium bromide, anti-agglomerants, and combinations thereof.

19. The system of claim 13, wherein each surface vessel is adapted for receiving the hydrocarbon mixture from said at least one conduit via a submerged turret loading system.

* * * * *